US005261143A

United States Patent [19]

Toth

[11] Patent Number: 5,261,143

[45] Date of Patent: Nov. 16, 1993

[54] SPAR TRACK CLEANING AND MAINTENANCE DEVICE

[75] Inventor: John B. Toth, 11685 W. 25th Ave., Lakewood, Colo. 80215

[73] Assignee: John B. Toth, Lakewood, Colo.

[21] Appl. No.: 869,960

[22] Filed: Apr. 17, 1992

Related U.S. Application Data

[63] Continuation-in-part of Ser. No. 623,692, Dec. 7, 1990, Pat. No. 5,140,718.

[51] Int. Cl.[5] ..... A47L 25/00

[52] U.S. Cl. ..... 15/210.1; 15/104.94; 114/221 R

[58] Field of Search ..... 15/104.93, 104.94, 209.1, 15/210.1, 220.4, 222, 246; 114/102, 103, 105, 108, 221 R; 134/6, 8, 42; 118/254; 401/9; 51/294, 400

[56] References Cited

U.S. PATENT DOCUMENTS

| | | | |
|---|---|---|---|
| Re. 31,829 | 2/1985 | Stearn | 114/108 X |
| 3,058,138 | 10/1962 | Tomlinson | 15/104.94 X |
| 3,332,103 | 7/1967 | Case | 15/210 R X |
| 3,658,025 | 4/1972 | Hood et al. | 114/105 |
| 3,851,609 | 12/1974 | Stearn | 114/108 X |
| 3,961,392 | 6/1976 | Young . | |
| 4,114,504 | 9/1978 | Koregelos | 15/206 X |
| 4,208,755 | 6/1980 | Shepherd . | |
| 4,278,472 | 7/1981 | Swanson . | |
| 4,899,416 | 2/1990 | Francis | 114/221 R X |

*Primary Examiner*—Harvey C. Hornsby
*Assistant Examiner*—C. Codley
*Attorney, Agent, or Firm*—Ken Richardson

[57] ABSTRACT

A device maintains an elongated, generally, T-shaped, spar track for a free running of mating slides and boltropes under loadings of a sail through cleaning and maintenance. A first internal surface region of the T-shaped track opening is comparatively wider than a second internal surface region of the track opening. The second internal surface region merges with a third external region of the track opening. The improvement comprises a compressible, flexible, pliable member for cleaning, lubricating and maintenance of the T-shaped track opening. The pliable member is prefolded and united to provide a T-shape corresponding to the shape of the track opening. The pliable member is provided with a T-shape to facilitate insertion of the pliable member into the track opening and to enable the pliable member to be in slidable engagement with the track opening. A control member adjustably shapes the pliable member when inserted within the track opening to cause the pliable member to compress and to substantially correspond to the T-shape of the track opening. The inserted pliable member is in slidable engagement with the track opening when subjected to compression through the control member, and when being slidably moved to allow the effects of corrosion to be reduced, and thereby, enhance a free running of the slides and boltropes under the loadings.

36 Claims, 4 Drawing Sheets

SPAR TRACK CLEANING AND MAINTENANCE DEVICE

This is a continuation-in-part of an application having Ser. No. 07/623,692, filed Dec. 7, 1990, now U.S. Pat. No. 5,140,718, which is made a part hereof and incorporated by reference herein.

BACKGROUND OF THE INVENTION

1. Field of the Invention

This invention generally relates to the cleaning and preventive maintenance of sailboats, and more particularly, to a device for maintaining a spar track for the free running of sail slides and boltropes under sail loadings.

2. Background of the Invention

Sails, supporting spars and rigging form a sailboat system for movement and navigation. A spar can generally be defined as a pole or system of poles used to support sails. Spars are used herein to describe other sail supports such as mast, booms, gaffs and headfoils. The handling of sails to allow navigation of the sailboat, particularly the hoisting and lowering of sails, depends on spar tracks or grooves and mating slides, slugs, boltropes and luffropes.

Tracks can be generally described as elongated slot-like or channel-like fittings having a T-shaped or bottle-shaped profile and are normally longitudinally positioned on a spar. Slides or slugs are usually interchangeably referred to and may be simply described as fittings that interconnect the sail and the spar track to hold the sail thereto.

Similarly, boltropes and luffropes typically function to interconnect and hold the sail to the spar. Boltropes are usually stitched to a bottom edge or foot of a sail, while luffropes are typically stitched to a luff edge or forward edge of a sail. Boltropes and luffropes are substantially equivalent to one another, although boltropes normally are used with different types of spars than luffropes. For instance, boltropes are typically used with boom tracks, while luffropes are normally used with mast tracks. Therefore, boltropes will be defined herein to include luffropes.

A number of spar tracks are fabricated from metal, metal alloy, or plastic materials. Spar tracks so constructed are designed to mate with boltropes and slides fabricated from non-metallic natural materials or non-metallic synthetic materials. Some spar track and mating slide arrangements are completely made of metal, metal alloy or plastic materials. The metal of popular choice for fabricating spar tracks is aluminum. This choice is dictated in part because of aluminum's great strength, durability, weight and low cost with respect to other marine metals, and because aluminum spars will normally be hollow and comprise extruded aluminum tracks.

Slides and boltropes are inserted within the spar tracks through openings therein. The inserted slides and boltropes cannot become free at the narrow slotted area of a spar track, and thus, are retained within a large internal portion thereof. Lowering or raising a sail requires the slides and boltrope to slide within the spar track usually under heavy loadings of the sail. As alluded to previously, maintaining the spar tracks for the free running of the slides and boltropes are of prime importance for sail, track and slide preservation, as well as sailboat safety and enjoyment. Impediments to the lowering and raising of sails through the binding, jamming, buckling or breaking of slides and boltropes can be disastrous. This is particularly true on choppy or rough water and windy conditions.

Friction caused by the effects of weathering and corrosion are the main villains to prevent the free and sure running of boltropes and slides within the spar tracks. A build-up of grime, and when in seawater, salt, is an ongoing problem with tracks and slides fabricated from plastics. Dampness, saltspray and high humidity exposes all metal tracks and metal slides to a constant threat of corrosion and oxidation. Even stainless steel and aluminum fittings will corrode or oxidize under certain circumstances, depending upon the alloy used in their manufacture, and the amount of exposure the stainless steel and aluminum is subjected to.

Metal tracks and slides, like all metals used for marine applications, are normally subjected to three types of corrosion, which contributes to causing undesirable friction and related difficulties in sail handling. The three types are galvanic corrosion, electrolyte corrosion and atmospheric corrosion.

Generally, galvanic corrosion occurs when two dissimilar metals, wherein one acts as an anode and the other acts as a cathode, are coated with an electrolyte. An electrolyte can simply be described as a liquid that produces an electric current. The current flows from the anode to the cathode which causes corrosion through deterioration of the anode. Large bodies of freshwater usually carry impurities that can harmfully serve as an electrolytic. Saltwater, however, is a much better conductor than freshwater, and thus, poses a more serious problem to metal spar tracks and slides.

Electrolytic corrosion normally results from an electric current coming from an outside source, such as a leakage due to an improper grounding systems, and is not self-generating. An electrolytic must still be present to carry the current from the anode to the cathode, but the metals do not have to be dissimilar.

Lastly, atmospheric corrosion usually occurs through a presence of corrosive elements such as oxygen, carbon dioxide, sulfur and chlorine with water or dampness. Atmospheric corrosion typically results in etching, pitting and rusting in iron, steel and other ferrous metals. Also, atmospheric corrosion forms greenish or brown oxide films on bronze and brass, as well as causing brittleness in brass. Similarly, it results in pitting and the forming of cloudy or dull oxide streaks or films on aluminum spars with extruded tracks.

As mentioned previously, the results of corrosion-induced pitting, rusting and the forming of oxide films and streaks at the metal tracks and slides, as well as the build-up of salt or grime thereon increases the unwanted friction between surfaces of the tracks and slides. This friction is a resistance to the movement of the slides and boltropes and effectively acts to break their movement during sail hoisting or lowering.

In some instances, slides bent or buckled through jamming cause an additional stress to adjoining sail cloth resulting in premature wear, fatigue and subsequent breakdown or failure. Additionally, the build-up of salt or grime or the fouling effects of corrosion within the spar tracks often acts as an abrasive. The abrasive track surface frequently results in harmful chaffing and abrasion of the boltrope as it runs through the track, especially when the boltrope is under tension, and there is a likelihood of movement. Unfortunately, boltrope tension and movement are conditions that are almost always present when a sailboat is on the water. Further, metal tracks which discolor through oxidation, in turn, often undesirably discolor or stain the sail cloths. Discolored and stained sailcloth enhances the sail's ability to pick up abrasive dirt and grime and be subjected to chaffing and associated premature failure.

Various approaches to the needs and problems associated with eliminating friction caused by corrosion and weathering at the surfaces of spar tracks and mating slides and boltropes include, for example, the following. Bare metal spars and their tracks are usually washed and treated with a mild abrasive or a sandpaper to remove corrosion, and thereafter, are waxed to reduce friction. However, this surface treatment is extremely difficult to perform once the spar has been stepped or mounted to the sailboat keel or the deck. The upper narrow slot-like opening in the spar track makes reaching, cleaning and coating the wider, lower portion of the internal track surface particularly hard, even when the spar is not standing.

Once the spar is stepped, the internal track surface, especially the portion of the track adjacent the mast head, is virtually inaccessible without a bosun's chair or climbing steps. Notably, a bosun chair is typically needed to free both hands for effectively performing the cleaning and maintenance tasks. Being hauled aloft in a swinging bosun's chair while the boat is even gently rocking can result in injury and dropped tools can cause damage and injury below. Additionally, building or purchasing climbing steps, which are normally welded or riveted to aluminum spars and bolted to wooden spars, are usually a costly option.

Bare metal spar tracks are also painted to form an impervious layer thereon. This layer denies access to the metal by an electrolyte and oxygen and prevents current flow and oxidation. The main shortcomings of paints, resins, lacquers and similar coatings and films is that the coating must be applied to the entire internal surface, that is, every corner, crevice and curvature thereof. As previously mentioned, it is extremely troublesome to generally access and coat the internal track surface of a standing spar without going aloft. To coat the entire internal track surface even with the help of a spraying device is difficult whether the spar is standing, or is laying down in a cradle. This shortcoming is greatly intensified when it is realized that preventing microscopic holes supplied by time and abrasion within the protective coatings that allow corrosion to begin is especially tough.

Bare metal tracks, other than stainless steel, are frequently anodized to coat the metal with a corrosive resistant material. Chrome and gold are sometimes used for this purpose. Unfortunately, scratching or damages of any kind to the anodized surface bares the metal and initiates corrosion. Also, corrosive-resistent anodic coatings frequently do not protect against direct spray that detrimentally pits the anodized surface with deposits.

To protect anodized surfaces from pitting, they are often initially treated with a clear plastic lacquer or an epoxy paint and thereafter waxed. However, as previously mentioned, the application of paints and other coatings to provide a protective film over the entire internal spar track surface is an arduous task after the spar has been stepped.

Some metals other than the popular aluminum have been selected to fabricate tracks because of their extremely corrosive-resistent characteristics and their excellent strength, such as, monel and titanium. However, these metals are comparatively expensive with respect to aluminum. Other metals are often too heavy for track applications.

Some metal tracks are provided with slides having metal or plastic ball or roller bearings and are mechanically designed to be adjustable under sail loads. However, these slides are typically comparatively complex in construction, are mostly used on large boats from about 35 feet and longer, and are comparatively costly with respect to other slides.

Some spar tracks use plastic and nylon slides. The disadvantage of plastic and nylon slides in seawater is that even a slight coating of salt on them will often stop the movement of the plastic and nylon slides.

To cope with these problems, prior art cleaning, lubricating and waxing devices usually comprised rags and sponges, which were coated with an anticorrosive material and caused to run inside the spar tracks by tieing the rag or sponge between a downhaul line and a hoisting line. A major disadvantage of such devices, however, is that the rags and sponges do not satisfactorily reach and contact the entire internal surface of the spar tracks.

U.S. Pat. Ser. No. 4,278,472 describes an implement for cleaning bolt line tracks in sailboats, which includes a pair of stiff, transversely spaced, insertion cores that are enclosed in a bonded nappy fabric to make a stiff, non-buckling assembly. The implement is connected between a halyard line and a trailing line, and the first core is inserted into the bolt line track. The two lines are worked reciprocally to move the implement along the bolt line track to dislodge material therefrom. However, this stiff, non-folding and non-buckling design may not allow substantial conformance to and contact with the entire internal bolt line track surface; may not be adjusted to substantially conform to and engage the entire internal surface after insertion within the track when it initially does not conform to nor engage the track surface; and may not allow the second core to assist the inserted first core in cleaning the upper slot-like area of the bolt line track.

OBJECTS OF THE INVENTION

It is therefore a general object of the present invention to provide an easy to use device and process for simplifying the cleaning and maintenance of spar tracks.

It is another general object to provide a device for facilitating and simplifying the lubricating and waxing of spar tracks.

It is still a general object to provide a device to inhibit corrosion of the internal surface of spar tracks.

It is a specific object to provide a simply constructed device and simplified process for maintaining a T-shaped spar track for the free-running of slides and boltropes therein under vertical or horizontal sail loadings.

It is another specific object to provide a device and process for the cleaning and maintenance of a spar track after the T-shaped spar is stepped without the need of a bosom chair, climbing steps, or a need to hoist oneself aloft on a halyard.

It is still a specific object to provide a cleaning and maintenance device for spar tracks that adjustably allows the device to compress and snugly conform to an internal T-shaped of a spar track while maintaining slidable contact therewith.

Additional objects, advantages and novel features of the present invention will be set forth in part in the description which follows, and in part will become apparent to those skilled in the art upon examination of the following, or may be learned by practice of the invention. The objects and advantages of the present invention may be realized and attained by means of the instrumentalities and combinations particularly pointed out in the appended claims.

SUMMARY OF THE INVENTION

To achieve the foregoing and other objects and in accordance with the purpose of the invention as embodied and broadly described herein, a device for maintaining a spar track for a free running of mating and boltropes under loadings of a sail through cleaning and maintenance is described. A first internal surface region of the T-shaped track opening is comparatively wider than a second internal surface region of the track opening. The second internal surface region merges with a third external surface region of the track opening. The improvement comprises a compressible, flexible, pliable member for cleaning, lubricating and maintenance of the T-shaped, track opening. The pliable member is prefolded and united to provide a shape corresponding to the T-shape of the track opening. The pliable member comprises a T-shape to facilitate insertion of the pliable member into the track opening and to enable the pliable member to be in slidable engagement therewith. A control means adjustably shapes the pliable member when inserted within the track opening to cause the pliable member to compress and to substantially correspond to the T-shape of the track opening. The inserted pliable member is in slidable engagement with the track opening when subjected to compression through the control means, and when being slidably moved to allow the effects of corrosion to be reduced, and thereby, enhance a free running of the slides and boltropes under the loadings of the sail.

BRIEF DESCRIPTION OF THE DRAWINGS

The accompanying drawings, which are incorporated in and from a part of the specification illustrate the preferred embodiments of the invention and together with the description, serve to explain the principals of the invention. In the drawings.

BEST MODE FOR CARRYING OUT THE INVENTION

Figure 1:
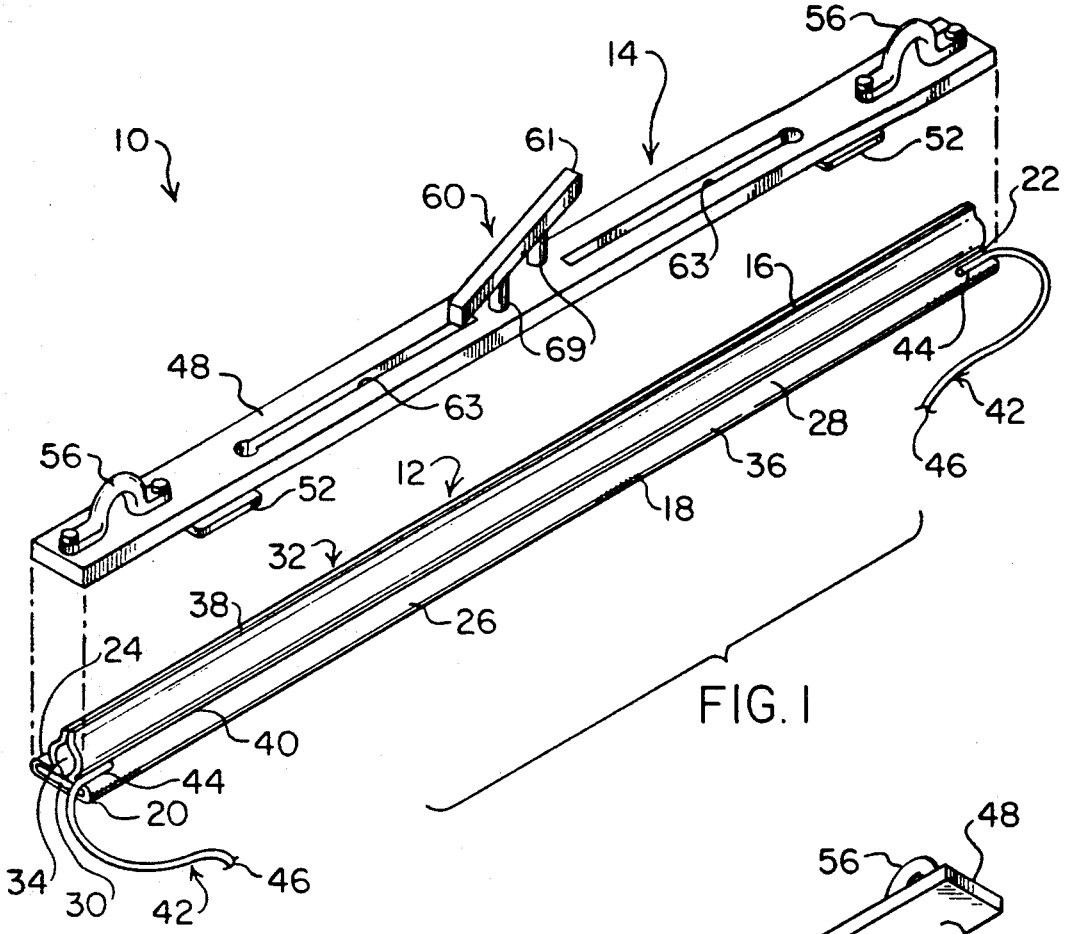
FIG. 1 is a partially exploded, perspective view of the spar track cleaning and maintenance device constructed in accordance with the invention.
Figure 2:
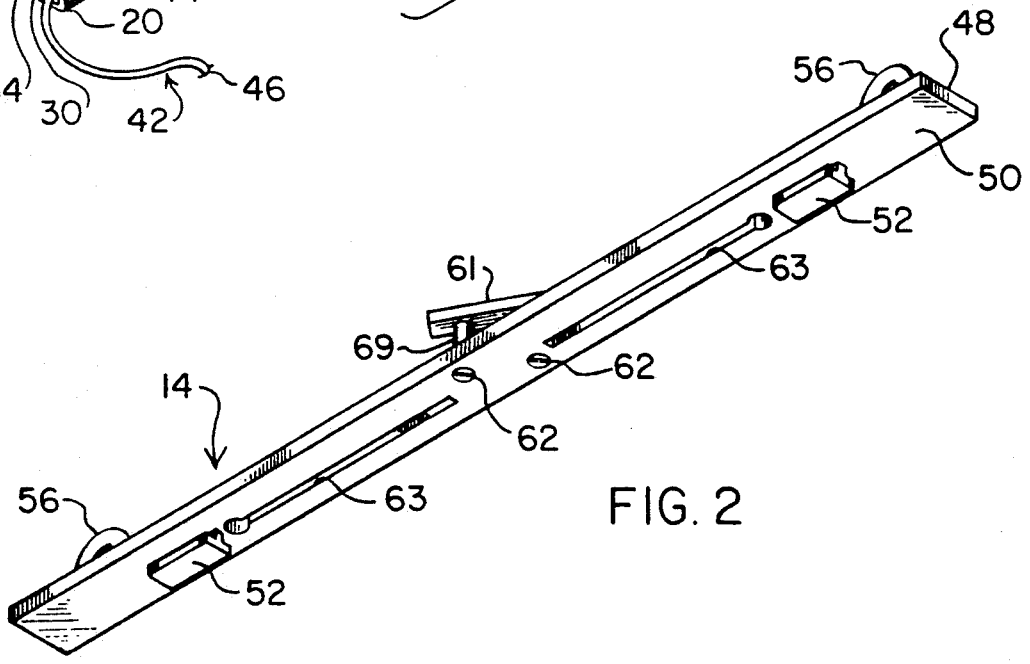
FIG. 2 is a perspective view of a holder member of the spar track cleaning and maintenance device of FIG. 1.

Referring now to the drawings, and more particularly to FIGS. 1 and 2 thereof, the present invention relates generally to a spar track cleaning and maintenance device. The spar track and cleaning maintenance device is generally denoted by the reference numeral 10 and comprises a compressible or contractible, resiliently flexible, pliable fabric member, generally denoted by reference numeral 12. Device 10 further includes an elongated, holder member generally denoted by the reference number 14 for securing thereto pliable fabric member 12. Pliable fabric member 12 possesses suitable characteristics to resist abrasion and chemical attack by cleaning and maintenance materials, and inherently defines a working surface that is capable of receiving or being impregnated with a friction-reducing material.

As is contemplated and defined herein, a friction-reducing material includes any number of well-known coatings used to protect spar tracks and spar grooves from the harmful effects of weathering and corrosion. The friction-reducing material also includes several well-known materials used to reduce friction between boltropes, slides, spar tracks, and grooves at their surfaces of contact. Such friction-reducing materials include, for example, but are not limited to paints, lubricants, waxes, oils, lacquers, abrasives, resins gels, soaps and cleaning solvents. Incidently, it will be noted that spar tracks are substantially equivalent to spar grooves, that spar tracks are used interchangeably for spar grooves in the marine art, and therefore, are used herein to define spar grooves.

Pliable member 12 may be manufactured from numerous well-known natural materials such as cotton cloths and woolen cloths, as well as synthetic materials such as nylon, polyester and teflon cloths. Pliable fabric member 12 is preferably manufactured from cotton. However, it will be understood that other suitable materials having adequate characteristics such as: conformability, compression, tensile, weave, finish, porosity and abrasiveness, as well as other characteristics for bearing thereon friction-reducing materials, may be used to manufacture pliable member 12, as will occur to those skilled in the art.

In a preferred construction, pliable member 12 comprises a rectangular shape and is prefolded and united to provide a shape corresponding to a predetermined shape of a spar track opening. Specifically, pliable member 12 is prefolded to form an elongated, T-shaped, sleeve structure corresponding to a T-shape defined by a spar track opening. The T-shaped, track opening is generally denoted by the reference numeral 15, while the spar is denoted by reference numeral 17, as is best shown at FIGS. 4–7. Returning to FIGS. 1 and 2, pliable member 12 further includes a top side 16; a bottom side 18; two opposed, longitudinally spaced, transverse extending, terminal or peripheral edge sides 20, 22; and two transversely spaced, longitudinal sides 24, 26.

In the present instance, pliable member 12 is also prefolded to provide a first, generally flattened, support region or section generally denoted by reference numeral 28, which defines a recess for enclosing therein a compressible, generally flattened, perforated or webbed sheet member 30. The prefolded pliable member 12 further includes a second finger or strip section generally denoted by reference numeral 32. Strip section 32 defines a recess for enclosing therein a first compressible, or contractible, resiliently flexible, elongated, structural member 34. Structural member 34 and webbed sheet member 30 are both disposed within pliable member 12 so as to extend in a longitudinal direction in a parallel relationship to longitudinal sides 24, 26. Upon inspection of FIG. 1, it will be seen that the first strip section 32 is integrally formed with respect to the first flattened section 28 so as to project upright therefrom and provide pliable member 12 with the T-shape, which generally corresponds to structural configuration of track opening 15.

Pliable member 12 is preferably permanently united by straight stitching 36. Top side 16 and bottom side 18 are sewn together at peripheral or border regions of transverse edge sides 20, 22 of both the first flattened section 28 and the first strip section 32. Pliable member 12 is further sewn along longitudinal edges 24, 26. Additionally, strip section 32 is sewn along two, adjacent, longitudinally extending, top, terminal edges 38. Finally, sheet member 30 along with structural member 34 are sewn to pliable member 12 along two, transversely spaced, longitudinally extending folds 40 defined by strip and flattened section 32, 30. Through stitching 36, flattened and strip sections 30, 32 are retained within the recesses inherently defined by the folds of the prefolded pliable member 12.

It will now be apparent that pliable member 12 is not limited to being united with straight stitching 36. Alternatively, pliable member 12 may be attached through other well known stitches, such as a zig-zag stitching or serge stitching. Moreover, pliable member 12 may also be attached through any number of well-known adhesives or fasteners. Such adhesives and fasteners should be suitable for enabling the united regions of pliable member 12 to provide little resistance to crushing and distortion. The adhesives and fasteners should also be suitable for receiving tensile and compression forces during cleaning and maintenance applications, while simultaneously inhibiting failure or separation of the united regions of pliable member 12, as will become more apparent hereinafter.

The elongated structural member 34 enclosed within strip section 32 may be fabricated from many well-known natural materials and synthetic materials having the aforesaid suitable flexibility and compression characteristics required for cleaning and maintenance applications. Suitable tensile and strength characteristics, as well as wear-resistent and chemical-resistent characteristics are also desirable. Examples of such materials are nylon, polyester, manilla, sisal, hemp, coir, metal and etc. A preferred embodiment of structural member 34 comprises an elongated, cordage material fabricated from nylon which, in turn, includes a double braid-type weave.

It is contemplated that sheet member 30 in conjunction with structural member 34 provides rigidity and body to pliable member 12 with respect to the flexibility characteristics of the cloth material comprising pliable member 12. Such rigidity enables pliable member 12 to maintain its T-shape and to assist holder member 14 in retaining pliable member 12 within spar track opening 15, as will be more fully explained hereinafter. To provide rigidity, sheet member 30, as previously mentioned, is in the form of an elongated, generally flattened, rectangularly shaped, perforated or webbed bar or blade. The perforated structure of sheet member 30 may be achieved by fabrication from well known natural and synthetic materials having the aforesaid compression and pliability characteristic required to assist holder member 14 in retaining pliable member 12 within track opening 15. For example, sheet member 30 may be fabricated from the same materials previously described for fabricating structural member 34. A preferred material is nylon webbing.

Turning now to FIGS. 1–4, device 10 includes a control or regulator means, generally denoted by the reference numeral 42, for adjustably shaping and maintaining a desired amount of compression on flattened and strip sections 28, 32 through pliable member 12, as will be more fully explained hereinafter. Control means 42 comprise a pair of high-strength, flexible, cordage members which, notably, may preferably be fabricated from the same materials used to fabricate structural member 34. In the present instance, control means 42 preferably comprises nylon cord which are in the form of a pair of drawlines.

Each drawline of control member 42 defines a first peripheral end 44, as is fully illustrated in FIG. 1. Each peripheral end is permanently attached to a different, longitudinally spaced, opposed, top region of pliable member 12 close to a matching, transverse, sides edge 20, 22. Each drawline end 44 is preferably sewn to a top side of pliable member 12 at flattened section 28, and further defines a second peripheral end 46. Each peripheral end 46 permits a compression or squeezing force to be applied to pliable member 12, and thereby applied to flattened and strip sections 28, 32.

Figure 3:
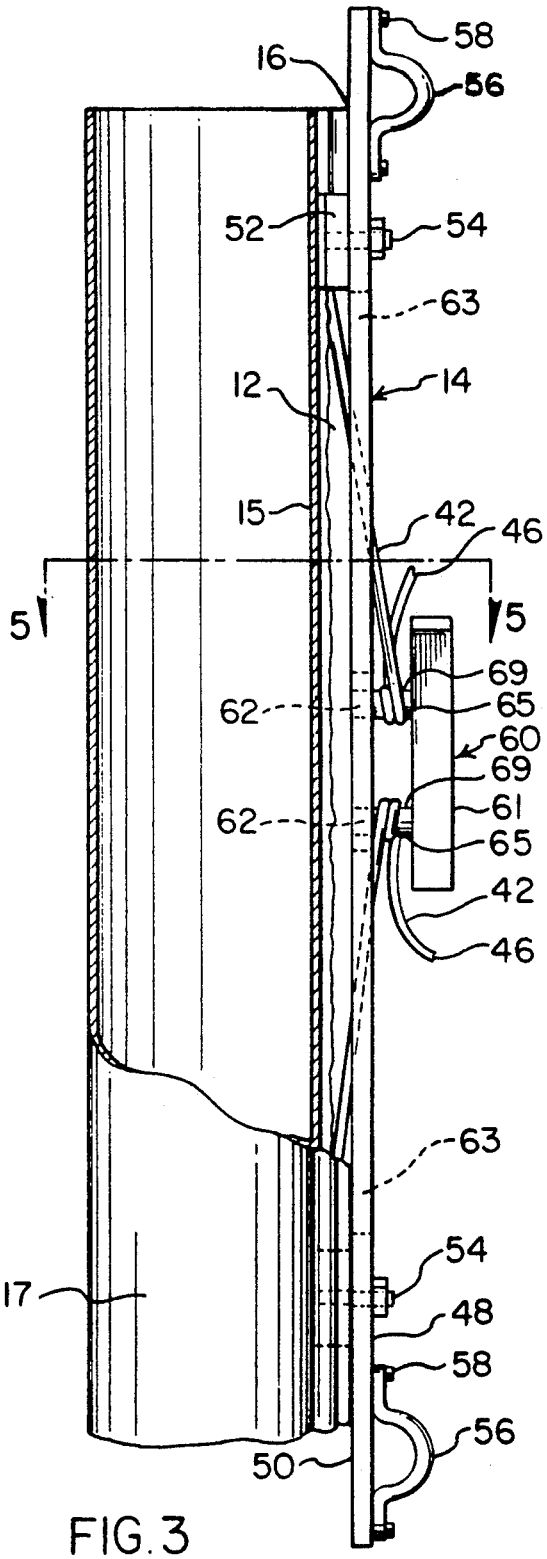
FIG. 3 is a side view of the spar track cleaning and maintenance device of FIG. 1, illustrating the pliable member inserted within a T-shaped, spar track opening when adjustably compressed to slidably engage the T-shaped track opening.

It is a feature of the present invention that holder member 14 in its preferred form comprises an elongated, metal bar that serves to retain pliable member 12, when inserted within track opening 15, in slidable contact therewith. Holder member 14 is preferably fabricated from stainless steel and includes a top side 48 and a bottom side 50. Bottom holder side 50 includes at least two, longitudinally-spaced, conventional, track slides 52 for removably, slidably, fixing holder member 14 to track opening 15. Track slides 52 maybe fastened to holder member 14 with conventional fastener such as nuts, bolts, screws and rivets. In the present instance, track sides 52 are preferably mounted to holder 14 with nuts and screws along with associated mating apertures therefor, which are generally denoted by the reference numeral 54, and which are best shown at FIG. 3. Nuts and screws 54 may comprise any well known type suitable for fastening slides 52 to holder member 14 through the mating apertures.

Top side 48 includes two longitudinally spaced, curved, staple-shaped or round metal fasteners 56 for permitting slidable movement of holder member 14 when subjected to a pulling force, as will become more apparent hereinafter. Fasteners 56 may be attached to holder member 14 by a member of conventional fastening practices, for example, fastener 56 may be screwed to holder member 14 with conventional fasteners, such as nuts and bolts or screws or rivets, or it may be welded to fastener 56. However, fastener 56 is preferably attached to holder member 14 with rivets 58.

Top side 48 further includes a locking member, or a cleat generally designated by reference numeral 60, for receiving and holding fast the drawlines of control means 42. Notably, cleat 60 is not limited to the illustrated bridge-like structure and may be in the form of a solid upright member or base. In the present instance, to permit adjustably connecting control means 42 to locking member 60, locking member 60 is preferably in the form of a handle-shaped grip, which is fastened to holder member 14 with conventional fasteners. Locking member 60 is also preferably attached to holder member 14 with screws and bolts through appropriate apertures, which are generally designated by reference numeral 62.

More specifically, locking member 60 structurally provides a bar member 61, which bridges two spaced upright member 69, so as to provide locking member 60 with an arch shape. Moreover, to enable connecting control means 42 to locking member 60, holder member 14 includes a pair of longitudinally spaced, elongated, generally, bone-shaped apertures 63. Aperture 63 receive therethrough the pair of drawlines of control means 42 to allow tieing to locking member 60, one drawline being adapted for insertion through a matching aperture 63, as is best illustrated in FIG. 3.

Figure 4:
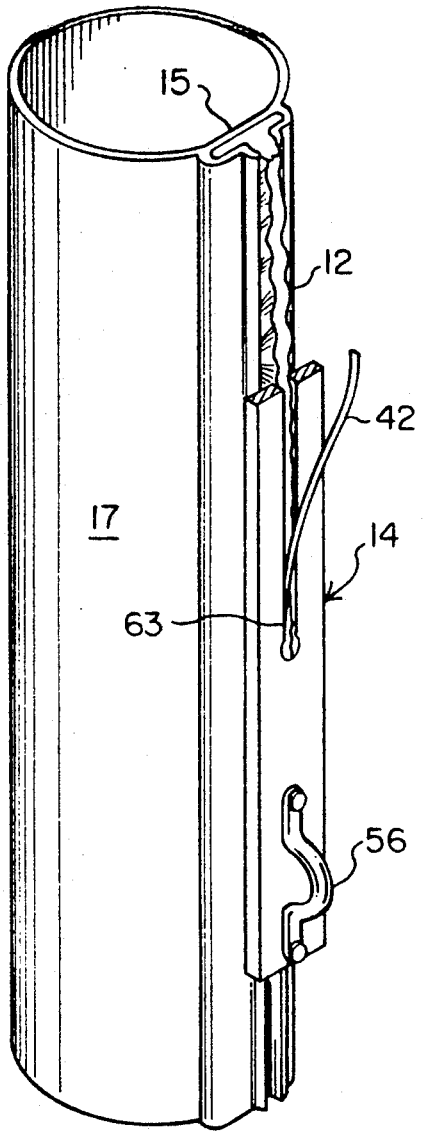
FIG. 4 is a perspective view of the spar track cleaning and maintenance device of FIG. 1, illustrating the pliable member inserted within the T-shaped, spar track opening when adjustably compressed to slidably engage the T-shaped track opening.
Figure 5:
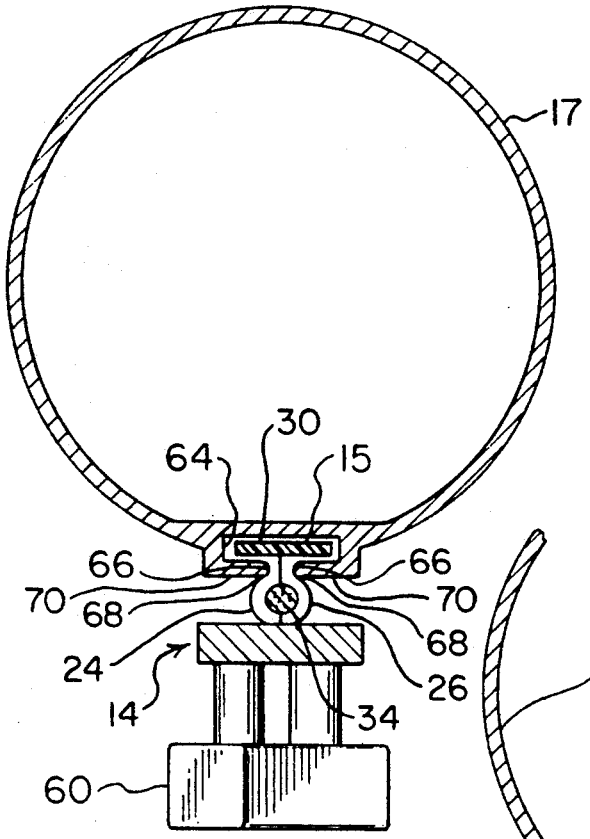
FIG. 5 is a cross-sectional, top view of the spar track cleaning and maintenance device of FIG. 1, illustrating a first flattened section and a strip section of the pliable member inserted within the T-shaped track opening.

The process of using device 10 for cleaning and maintenance of spar tracks may be best understood upon reference to FIGS. 3 through 5. Referring firstly to FIG. 5, attention is drawn to the fact that track opening 15 comprises a first, internal surface region 64. Internal surface region 64 is in the form of an elongated, sort of rectangular, channel-shaped opening defined by the boundaries or confines of track opening 15. Track opening 15 also comprises a second internal surface region 66 that is comparatively substantially narrower than the first surface region 64, such that, second internal surface region 66 provides track opening 15 with an elongated, relatively narrow, neck structure. Internal track opening further includes a third surface region 68 at peripheral edges of track opening 15. Notably, third surface region 68 is defined herein as beveled or all angled or slanted surface regions consisting or merged areas or portions of second or third surfaces 66, 68. Finally, spar 17 defines a fourth external surface region 70 which is contiguous with third external surface region 70 which is contiguous with third external surface region 68.

To clean and provide preventive maintenance at all internal surfaces 64, 68 and 68 and external surface 70 of spar 17, a first tack slide 52 of holder member 14 is initially inserted or bent on to the spar track through a spar opening. It will be noted that such openings are provided by spar manufacturers to permit track slide insertion, and that the specific details of the spar opening forms no part of the present invention. Thus, the spar opening has been omitted from the drawing for the sake of clarity and brevity, since such openings are well known in the marine art. Thereafter, the pliable member 12 is inserted into track opening 15.

Next, each one of the pair of drawline ends 46 of control means 42 is inserted through a corresponding one of holder apertures 63 to permit fastening to locking member 60, as will be more fully explained hereinafter. To complete locking holder member 14 in slidable engagement with track opening 15, the remaining track slide 52 of holder member 14 is inserted within the spar opening 15.

As contemplated by the invention, when holder member 14 is fixed to spar track opening 15, pliable member 12 is sandwiched between holder member 14 and tack opening 15. So located, bottom side 50 of holder member 14 is caused to exert a film pressing force or pressure on top strip side 16 of pliable member 14, and to slidably retain pliable member 12 between holder member 14 and track opening 15. A level or degree of pressure exerted on pliable member 12 is adjustably set by the proximity of holder member 14 and track opening 15 through track slides 52. From an inspection of FIG. 3, it is evident that the closer holder member 14 is attached to track opening 15, the greater magnitude of pressure that will be caused to bear on top strip portion 16. Conversely, the further holder member 14 is separated from track opening 15, the less pressure will be caused to bear on top strip portion 16.

Thereafter, pliable member 12 is releasably coupled or fastened to holder member 14 through control means 42, which coupling incidentally actuated control means 42. Actuation is accomplished by pulling each one of the two drawlines 46 in counter longitudinal directions, attaching each drawline to a mating upright member 65 of locking member 60. During such pulling, holder apertures 63 enable a desired amount of compression to be applied to the drawline end 46 of control means 42 inserted through apertures 63. It is now evident that operating control means 42 allows pliable member 12 to be coupled to holder member 14, while concurrently allowing compression to be adjustably exerted on flatten and strip sections 28, 32 through pliable member 14.

Additionally, as a consequence of applying the pulling force to drawline ends 46, flattened and strip sections 28, 32 are squeezed within the T-shaped track opening 15, including the neck-shaped region of first and second surfaces 66, 68. During squeezing, pliable member 12 is also caused to abuttingly, slidably engage and conform to both the beveled third track surface 68 and fourth external spar surface 70. Moreover, pliable member 12, and thus, flattened and strip sections 28, 32 shorten and swell so as to form a sort of a sinusoided curve which facilitates a capability of pliable member 12 to correspond to the T-shape of track opening 15, and to substantially slidably contact internal surfaces 64, 66, and 68, as well as contact spar surface 70, as is best shown at FIG. 4.

It is now apparent that the desired magnitude of compression applied to pliable member 12 is adjusted by increasing or decreasing the pulling force applied to control means 42. Likewise, the desired level of contraction and snugness of pliable member sandwiched between holder member 14 and track opening 15 is adjustably maintained by tieing free drawline ends 46 around locking upright member 69 through a rope knot 69. So tied, locking member 60 functions to check compression forces acting on pliable fabric member 12, and thereby, prevents the expansion thereof.

Next, in the cleaning and maintenance operations, a pulling or a tugging means is attached to each one of the two, staple-type fasteners 56 to enable pliable fabric member 12 to be reversibly moved, while located beneath holder member 14 within track opening 15. It is contemplated that one of the pulling means comprises a halyard or similar rope of line normally utilized for hoisting sails, while the remaining pulling means comprises any downhaul line or similar rope normally utilized for lowering sails. Halyards and downhaul lines are well-known in the marine art, and thus, have been omitted from the drawings for the sake of clarity and brevity. The halyard is attached through a rope knot or shackle to one of the two fasteners 56, and is pulled to move pliable member 12 in a first upward direction. Likewise, the downhaul line is attached to the remaining fastener 56 through a rope knot or shackle and is pulled to move the pliable fabric member 12 in a second direction opposite to the first direction.

It will now be appreciated that sequentially applying pulling forces to the halyard and downhaul lines causes a smooth slipping movement of holder member 14 and pliable member 12 within spar track 15 in first and second reversible directions. It will also be appreciated that the pressure exerted on pliable member 12 through holder member 14 serves to locate pliable member 12 between holder member 14 and spar track opening 15, and thereby, prevent pliable member 12 from becoming free of track opening 15, while under the influence of the compression force, and while being slightly moved within track opening 15.

Thereafter, the cleaning and maintenance of spar track opening 15 is performed by alternately slidably moving the compressed pliable member 12 through holder member 14 within spar track opening 15, back and forth, to and fro, in first and second opposite directions. For this purpose, the movement can be an oscillating, vibratory-type movement, or it can be a sustained slipping-type movement. A sustained movement is performed ny initially moving pliable member 12 in a first direction over a substantial longitudinal length of spar track, and then subsequently reversibly moving pliable member 12 in an opposite direction. Also, pliable member 12 is not limited to cleaning and maintenance requiring vertical movement, but may be employed to effect horizontal movement as well. For example, pliable member 12 can be used for cleaning and maintenance applications at a track disposed along a horizontally positioned boom-type spar.

From the foregoing, it is apparent that the size of device 10 depends on the specific cleaning and maintenance application being performed, as well as the type and size of the spar track being treated. The illustrative holder member 14 will be from around about 1 ft (304.8 mm) to around about 2 ft (609.6 mm) long; from around about ½ in. (12.7 mm) to around about 1½ in. (38.2 mm) wide; and from around about ⅛ in. (3.2 mm) to around about ¼ in. (6.4 mm) thick. So to, obviously, pliable member 12 will be of a size to effectively cooperate with holder member 14 to satisfactorily enable cleaning and maintenance of spar track 15.

Figure 7:
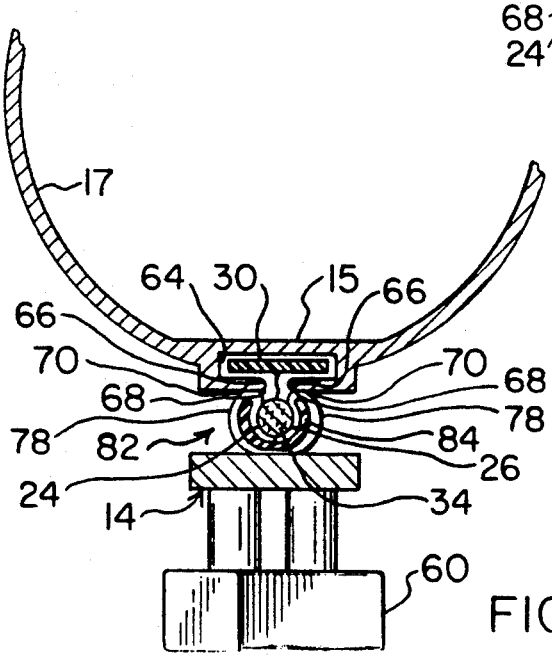
FIG. 7 is a view similar to FIG. 6, except illustrating a third variant of the pliable member of the spar track cleaning and maintenance device of FIG. 1.
Figure 8:
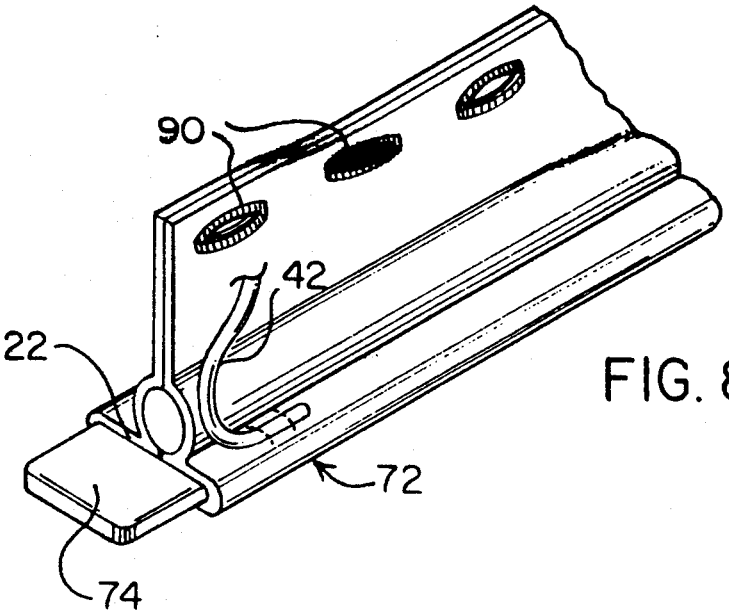
FIG. 8 is a fragmentary, perspective view of a first variant of the pliable fabric member of the spar track cleaning and maintenance device of FIG. 1.

As a first variant of pliable member 12, there is contemplated, as illustrated in FIG. 8, a pliable member 72 further comprising a pair of spaced, rigid, guide members 74. It will be understood that except for guide members 74, pliable member 72 is substantially identical in construction to pliable member 12. Accordingly, it will suffice for the present purpose to describe in detail only the features of pliable fabric member 74 that are different than those of pliable fabric member 12. Further, identical features of both FIGS. 1 and 7 embodiments of pliable member 12, 72 will be denoted by the same reference numerals. Moreover, the aforesaid approach of, first, only describing in detail features that are different than those features previously described in the embodiments of FIGS. 1–5, and second, using identical reference numerals for features of pliable member 72 that are identical to those designated in FIGS. 1–5, will be utilized for all variants and embodiments subsequently described herein below.

Guide member 74 serves to assist holder member 14 in directing the motion of pliable member 72 when pliable member 72 is being slid within track opening 15, and in retaining flattened and strip sections 28, 32 within track opening 15. Guide members 74 may be fabricated from any number of materials comprising the desired rigidity characteristics for allowing guide members 74 to assist holder member 14 in preventing pliable member 12 from becoming free of track opening 15 during the performance of cleaning and maintenance operations.

In the illustrated form, guide members 74 comprise a plastic material and include a flattened tubular-shape, which correspond to the channel-like shape defined by first internal surface 64 of track opening 15. It will be appreciated that only one guide member 74 is herein illustrated for the sake of brevity an clarity. Moreover, each one of the pair of guide members 74 are substantially identical in structure and in the manner in which it is attached to pliable member 12. Thus, a description of one guide member 74 will suffice for the description of the remaining guide member 74. Each one of the pair of guide members 74 are attached to a different, transverse sides 20, 22 of pliable member 72 and as previously alluded to, preferably, by pressing guide member 74 thereon. In performing cleaning and maintenance operations, pliable member 72 operates in substantially the identical manner as fully described for pliable member 12, except for the addition and action of guide members 74 in assisting holder member 14 to retain and guide pliable member 72 within track opening 15.

Figure 6:
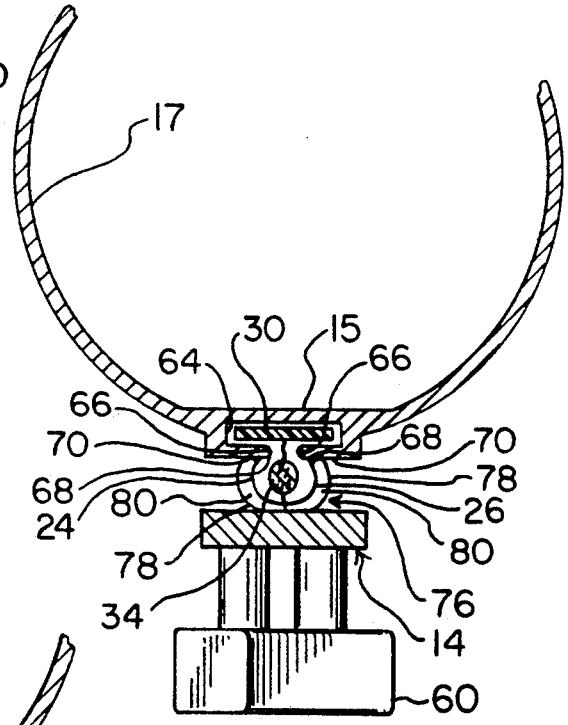
FIG. 6 is a view similar to FIG. 5, except illustrating a second variant of the pliable member of the spar track cleaning and maintenance device of FIG. 1.

As a second variant of pliable member 14, there is contemplated, as illustrated in FIG. 6 a pliable member 76 comprising a pair of portions 80 at a top region of strip section 32 that project transversely therefrom and guide members 74. From inspection of FIG. 8, strip section 32 is seen to include spaced, lateral, parallel, side walls 78. Side walls 78 extend from flattened section 30 and are contiguous with longitudinal sides 24, 26. In the present form, pliable member 76 is fabricated, prefolded and united to provide different portions of cloth material 80 to jut from a matching one of the pair of side walls 78. In cleaning and maintenance operations, projecting cloth material 80 is squeezed so as to slidably engage and conform to fourth external spar surface 70. From an inspection of FIG. 6, it is evident that projecting cloth material 80 provides pliable member 76 with a sort of H-shape cleaning and maintenance structure, and serves to reach a larger surface area of fourth external spar surface 70 than top strip section 32 of pliable member 12.

As a third variant of pliable member 12, there is contemplated, as illustrated in FIG. 7, a pliable member 82 comprising a second flattened section 84. Second flattened section 84 also provides pliable member 82 with an H-shaped, cleaning and maintenance structure. The structure of second flattened section 84 is virtually, substantially identical to the structure of first flattened section 30. However, second flattened section 84 is positioned at a top region 16 of strip section 32, instead of at the bottom region 18 of strip section 32. Also, pliable member 82 is sewn with stitching 30 at a top region 86 of second flattened section 84 intermediate longitudinal sides 24, 26. Similar to first flattened section 28, second flattened section 84 encloses sheet member 30 therein. However, second pliable member 82 serves to reach a larger surface area of external spar surface 70 than pliable member 14. So too, obviously, the addition material of second flattened section 84 that is squeezed between holder member 14 and track opening 15 enhances the cleaning and maintenance action of pliable member 84 with respect to the material provided by strip section 32 of pliable members 14.

Figure 9:
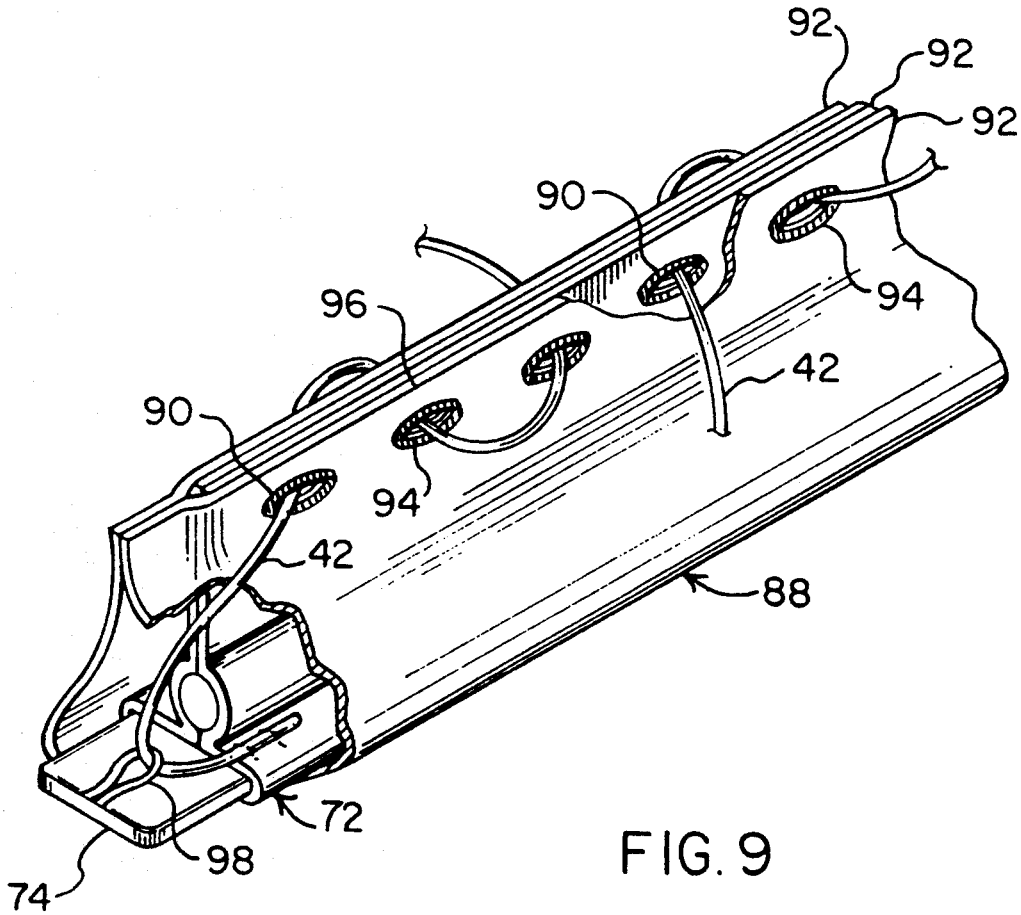
FIG. 9 is a partially broken, perspective view of the spar track cleaning and maintenance device of FIG. 1, illustrating a fourth variant of the pliable member of the spar track cleaning and maintenance device of FIG. 1.

As a fourth variant of pliable member 14, there is contemplated, as illustrated in FIG. 9, a pliable member 72 comprising a sacrificial or replacement pad or wrapping member, generally designated as reference numeral 88. Wrapping member 88 serves to fit around or enclose pliable member 72 and absorb or receive contaminants from the track opening 15 during cleaning and maintenance operations, such as, salt, dirt, rust and corrosion, grit and etc. It will be noted that pliable member 76 and wrapping member 88 when impregnated with such contaminants are prevented from satisfactory cleaning, lubricating, waxing or polishing track opening 15, unless wrapping member 88 and pliable member 14 are suitably cleaned to eliminate the contaminants therefrom. Thus, it is further noted that wrapping member 88 further serves to prevent pliable member 76 from receiving and becoming soiled with contaminants. Thus, the working surface of pliable member 76, defined by first flattened and strip sections 28, 32, is kept clean and ready for subsequent use or receipt of another replacement, clean wrapping member 88. Moreover, wear to the working surface of pliable member 76 that can arise from contact with external track surfaces 64, 66, and 68, especially at corners defined by track opening 15 is substantially minimized.

The illustrated wrapping member 88 comprises an elongated, rectangularly-shaped, fabric member. Wrapping member 88 is produced from the same group of synthetics and natural material, which are employed to perform cleaning and maintenance operations that comprise pliable member 76. Wrapping member 88 further comprises at least one pair of longitudinally spaced apertures 90 at a different side edges 92 thereof for removably attaching to pliable member 76. Preferably, wrapping member 88 comprises a plurality of longitudinally-spaced apertures 90 at each side 92 to allow connection to pliable member 76. Apertures 90 may be reinforced with metal or plastic grommets, and preferably are reinforced with stitching 94 to optimize flexibility of wrapping member 88, and resiliency, while providing suitable aperture strength to withstand failure due to crushing, squeezing and sliding when employed within track opening 15 during cleaning and maintenance operations.

To allow coupling between pliable member 76 and wrapping member 88, pliable member 76 is sized and prefolded to allow sufficient material adjoining stitched sides 38 of top strip side 16 to provide a plurality of aperture 96. Apertures 96 and 90 are identical in construction and are positioned in wrapping member 88 and strip section 30 so as to be in alignment with one another when wrapping member 88 is folded to enclose pliable member 76. When aligned, wrapping member 88 is folded around pliable member 76, such that, the shape of wrapping member 88 matches the T-shape of pliable member 76, and the plurality of apertures 90 of wrapping member 88 and 96 of pliable member 76 at strip top 16 align with one another to allow releasably fastening through control means 42. Incidentally, by such folding, wrapping member 88, while maintaining the T-shape of pliable member 12 is enabled to be inserted within track opening 15, and be in slidably engagement therewith.

To enable control means 42 to lock wrapping member 88 about pliable member 76, and have the capability to adjustably shape the coupled pliable and wrapping members 72, 88, pliable member 88 includes a pair of ring members 98. A different ring 98 is positioned at a different one of the two longitudinally spaced traverse extending sides 97, 99. Rings 98 serve to receive therein a corresponding free end 46 of the pair of drawlines of control means 42. It will now be appreciated that only one ring member 98 of the pair of ring members 98 is illustrated herein for the sake of clarity and brevity. However, both ring members 98 are substantially identical in structure, function and the manner in which it is attached to wrapping member 88. Thus, a description of one will suffice for the other.

Coupling pliable member 76 and wrapping member 88 is achieved by inserting a free end 46 through a matching ring member 98. Thereafter, each free drawline end 46 is passed through apertures 90, 96 in counter directions to lace together the pliable member strip sides and side wrapping member 88. It will now be seen from FIG. 9 that actuating control means 42 by pulling drawline ends 42 compresses both wrapping and pliable members 88, 76. Further, the compression allows wrapping member and pliable member 88, 76 to conform and substantially slidably contact track opening 15.

It will now be understood that device 10 is not limited to being used with holder member 14, and may be singly used. In this regard, the present invention contemplates providing first flattened member 28, or more precisely sheet member 30 enclosed therein, with sufficient rigidity to allow cleaning and maintenance operations to be performed with pliable member 12, while it is under the influence of compression and pulling forces without becoming free of track opening 15. Additionally, it will be understood that pliable member 12 may take the structure and form of the spar cleaning and maintenance device fully described in U.S. patent application Ser. No. 07/673,692, filed Dec. 7, 1990, now U.S. Pat. No. 5,140,718. Incidentally, U.S. Pat. No. 5,140,718 was invented and owned by the same owner and inventor of the instant patent application, that is John Toth, and is incorporated herein by reference. The teachings of the spar cleaning and maintenance structure in U.S. Pat. No. 5,140,718 aforesaid is adopted herein, for example, with respect to its control means for adjustably shaping its pliable member, its locking member; and its means for attaching pulling forces to its pliable member through a halyard and downhaul lines.

In keeping with the present invention, it is further contemplated that wrapping member 88 is not limited to use only with pliable member 76, and that wrapping member 88 may be used with pliable member variants 12 and 72, as well as with the fabric member described in U.S. Pat. No. 5,140,718. In the latter application of the present invention, it is also contemplated to provide the fabric member of the U.S. Pat. No. 5,140,718 with a plurality of apertures along its side edge between the grommets thereof for connecting with the halyard and downhaul lines. The plurality apertures are positioned within the fabric member, such that, they are in alignment with the plurality of apertures 90 of wrapping member 88, when wrapping member 90 is enclosed about the fabric member. The wrapping member 88 is releasably attached to the fabric member of the patent application with cordage member. In this fastening arrangement, the apertures of the fabric member and wrapping member 88 are individually connected with cord knots so as to releasably join wrapping member 88 and the fabric member together.

Having observed the details of construction and operation of the device 10, it will be apparent that the present invention provides several additional advantages as follows. Device 10 is of simple construction and provides a simplified method for substantially improving the ease of hoisting and lowering of sails through reducing friction between the external sliding surfaces of tracks and slides and boltropes and the sliding surfaces of the spar track so as to prevent jamming, binding and buckling. Device 10 allows cleaning and maintenance of a spar track to reduce friction therein after the spar has been stepped without a need for a bosom chair, climbing steps, or a need to hoist oneself aloft on a halyard. Device 10 improves an ability to reach and to fully coat the entire internal surfaces of a spar track including all crevices, curvatures, microscopic holes, abrasion and scratches with a friction-reducing material.

Other advantages can also be described. For instance, device 10 improves an ability to inhibit the forming of oxides and associated discoloration and sailing of sail cloths. Device 10 increases sailing safety by enabling sails to be easily lowered and hoisted. Device 10 simplifies maintenance and cleaning procedures. Device 10 minimizes harmful chaffing and abrasion of boltropes at the spar tracks, which, in turn, inhibits premature failure of the sailcloth. Lastly, the ability to adjust the compression of device 10 within a spar track allows one device size to be used with spar tracks that initially provide a loose fit with device 10 upon insertion into the spar track, without a need to change to a second device having a larger surface area.

The foregoing description of the preferred embodiment of the present invention has been presented for purposes of illustration and description. It is not intended to be exhaustive or to limit the invention to the precise form disclosed, and obviously many modifications and variations are possible in light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

I claim:

1. A device for maintaining an elongated, generally, T-shaped spar track for a free running of mating slides and boltropes under loadings of a sail through cleaning and maintenance, wherein a first internal surface region of a T-shaped opening is comparatively wider than a second internal surface region, and wherein the second internal surface region of said track opening merges with a third external region of said track opening; and wherein the improvement comprises:

a. a compressible, flexible, pliable member for cleaning, lubricating and maintenance of said T-shaped track opening; said pliable member being prefolded and united to provide a shape corresponding to said T-shaped track opening;

b. said pliable member resembling said T-shape of said track opening to facilitate insertion of said pliable member into said track opening and to enable said pliable member to be in slidable engagement with said track opening; and c. a control member for adjustably shaping said pliable member when inserted within said track opening; the control member adjustably shaping said pliable member to allow said pliable member to compress and to substantially correspond to said T-shape of said track opening; and wherein said inserted pliable member is in slidable engagement with said track opening when subjected to compression through said control member, and when being slidably moved to allow effects of corrosion to be reduced and thereby enhance a free running of said slides and boltropes under said loadings; and wherein said pliable member when compressed by said control member, is caused to effect a sinusoidal shape while compressed for facilitating said pliable member to slidably substantially contact said first internal surface region, said second internal surface region, and said third external region of said track opening.

2. The device of claim 1, wherein said pliable member includes at least one, elongated, first, flattened section and an elongated, raised, strip section for insertion into said track opening so as to be in slidable engagement with said track opening, said first flattened section and said strip section being integrally formed with said pliable member so as to structurally provide said slidable member with a shape generally similar to said T-shape of said track opening, the integrally formed structure of said first flattened section and said strip section facilitating the insertion of said flattened first section and said strip section into said track opening and the retention of the inserted said flattened section and said strip section within said T-shaped track opening; and said control member adjustably shaping said pliable member to allow said first flattened section and said strip section to compress and to substantially correspond to said T-shape of said track opening.

3. A device for maintaining an elongated, generally, T-shaped spar track for a free running of mating slides and boltropes under loadings of a sail through cleaning and maintenance, wherein a first internal surface region of a T-shaped track opening is comparatively wider than a second internal surface region, and wherein the second internal surface region of said track opening merges with a third external region of said track opening; and wherein the improvement comprises:

a. a compressible, flexible, pliable member for cleaning, lubricating and maintenance of said T-shaped track opening; said pliable member being prefolded and united to provide a shape corresponding to said T-shaped track opening;

b. said pliable member resembling said T-shape of said track opening to facilitate insertion of said pliable member into said track opening and to enable said pliable member to be in slidable engagement with said track opening; and c. a control member for adjustably shaping said pliable member when inserted within said track opening; the control member adjustably shaping said pliable member to allow said pliable member to compress and to substantially correspond to said T-shape of said track opening; wherein said inserted pliable member is in slidable engagement with said track opening when subjected to compression through said control member, and when being slidably moved to allow effects of corrosion to be reduced and thereby enhance a free running of said slides and boltropes under said loadings;

and wherein said pliable member includes at least one, elongated, first, flattened section and elongated, raised, strip section for insertion into said track opening so as to be in slidable engagement with said track opening, said first flattened section and said strip section being integrally formed with said pliable member so as to structurally provide said slidable member with a shape generally similar to said T-shape of said track opening, the integrally formed structure of said first flattened section and said strip section facilitating the insertion of said flattened first section and said strip section into said track opening; and the retention of the inserted said flattened section and said strip section within said T-shaped track opening; and said control member adjustably shaping said pliable member to allow said first flattened section and said strip section to compress and to substantially correspond to said T-shape of said track opening; and further comprising said first flattened section being in slidable engagement and in substantial contact with said first internal track surface when subjected to compression through said control member, said strip section being in slidable engagement and in substantial contact with said second internal track surface and said third external track surface, when subjected to compression through said control member, and wherein said T-shape of said pliable member allows a longitudinally extending, neck-shaped region of said track opening defined by said first and second internal track surfaces, to be located between said first and second internal track surfaces, such that, said strip section of said pliable member is squeezed within said neck-shaped portion of said track opening.

4. The device of claim 3, further comprising an elongated holder member for retaining said inserted first flattened section and said strip section in slidable engagement within said track opening; said holder member being removably, slidably fixed to said track opening with at least two spaced track slides, the at least two spaced track slides being attached to said holder member; said pliable member being releasably attached to said holder member in a manner for said holder member to exert a firm pressing pressure on said pliable member through said at least two track slides when said holder member is slidably fixed to said track opening; said holder member retaining said pliable member between said holder member and said track opening; and said pressure preventing said inserted pliable member from becoming free of said track opening while said first flattened and strip sections are being slidably moved within said track opening.

5. The device of claim 4, wherein said pliable member further comprises a pair of spaced, rigid, guide members for directing a motion of said pliable member when said pliable member is being slid within said track opening, and for retaining said inserted first flattened and strip sections within said track opening when said first flattened and strip sections are being slid within said track opening; each one of said pair of guide members being attached to a different one of an opposed, transverse, end side of said pliable member; and said pair of guide members having a shape corresponding to a shape of a channel-like aperture defined by boundaries of said first external surface region of said track opening.

6. The device of claim 5, wherein each one of said pair of guide members comprises a flattened plastic material.

7. The device of claim 6, wherein said holder member includes a top side and a bottom side; said bottom side of said holder member exerting said pressure on said pliable member, when said pliable member is said attached thereto; and said bottom side of said holder member retaining said pliable member between said holder member bottom side and said track opening.

8. The device of claim 7, wherein said control member includes a pair of cordage members fastened to said pliable member in a manner to allow said first flattened and strip sections of said pliable member when under the influence of the compression force to adjustably correspond to and slidably engage said internal T-shaped track opening; and wherein a locking means is joined to said holder member for releasably fastening said pair of cordage members thereto, and for adjustably maintaining a desired amount of said compression on said pliable member.

9. The device of claim 8, wherein said holder member comprises an elongated bar; said bar defining said top side and bottom side; said top side including a pair of spaced fasteners for attaching to an external pulling force; said holder member being caused to slide back and forth within said track opening when said pair of fasteners are subject to said pulling force; and wherein the sliding holder member causes said pliable member to concurrently slide back and forth within said track opening.

10. The device of claim 9, wherein each one of said pair of cordage members are fastened at a different, longitudinally spaced, opposed side of said pliable member through a first terminal end thereof; each one of said pair of cordage members including a second terminal end projecting from said pliable member for applying said compression to said pliable member, and for said adjustably maintaining the applied compression; said compression being applied when each one of said pair of cordage members receives said pulling force; said compression being adjustably maintained by releasably fastening the pulled pair of cordage members to said locking means; and said compression being adjusted by increasing and decreasing said pulling force applied to each second terminal end of said slidable member.

11. The device of claim 10, wherein said holder member through its bar structure located said locking member on said top side of said bar; said bar further including a pair of longitudinally spaced, elongated apertures for receiving therethrough a matching one of said pair of cordage members to effect fastening said pair of cordage members to said locking member; and said pair of apertures enabling the desired compression to be applied to said terminal ends of said cordage members, when each one of said pair of terminal ends is inserted through a corresponding one of said pair of apertures, and when each one of the inserted pair of terminal ends is pulled and releasably attached to said locking member.

12. The device of claim 11, wherein said holder member includes said at least two, spaced, track slides for inserting into said track opening to effect removably, slidably, fixing said holder member to said track opening; said track sides being disposed on a bottom bar side of said holder member; and said inserted track slides setting a level of said pressure being exerted on said pliable member; said level of pressure causing said holder member to maintain said pliable member between said bottom bar side of said holder member and said track opening, and to retain said first flattened and strip sections within said track opening, when said pliable member is fastened to said holder member inserted within said track opening.

13. The device of claim 12, wherein said pliable member is flexible, resilient and capable of receiving and maintaining thereon a friction-reducing material and a cleaning material for enhancing an ability of said pliable member to reduce a resistance of said internal track surfaces to the sliding motion of said slides and boltropes within said track opening, while being subject to loadings from the sail, subsequent to said device being used for maintenance of said track opening.

14. The device of claim 13, wherein said pliable member comprises a flat, rectangularly-shaped cloth; said cloth being prefolded to provide an united, elongated, T-shaped sleeve; said prefolded sleeve being formed to permit said first flattened section to enclose a compressible, pliable, elongated, perforated, sheet member; and said sheet member being capable of absorbing said friction reducing material and cleaning material.

15. The device of claim 14, wherein said prefolded sleeve is further formed to permit said strip section to enclose a flexible, pliable, elongated, support member; said support member being capable of absorbing said friction reducing material and cleaning material; and wherein said enclosed support member is integrally formed with respect to said enclosed sheet member therein so as to project upright therefrom.

16. The device of claim 15, wherein said sleeve is united by stitching; said first flattened and strip sections being sewn along transversely spaced, longitudinally extending, opposed, side edges of said sleeve; said sleeve being further sewn through said two transverse side edges of said pliable member; said strip section being sewn along two, adjoining, longitudinally extending, top edges thereof; two longitudinally extending folds of said strip being positioned intermediate said longitudinally extending sewn side edges of said sleeve; said strip section being further sewn with said sheet member at said longitudinally extending strip folds; and said sheet member being further sewn to said sleeve along said longitudinally opposed sheet sides.

17. The device of claim 16, wherein said sheet member comprises cotton webbing for providing said pliable member with a flattened shape; said support member comprising a cordage member fabricated from natural fibers for maintaining said strip member generally upright with respect to said first flattened section, and wherein said pliable member is fastened to said holder member, such that, said strip section abuttingly engages said holder member, when said holder member is said fixed to said track opening to provide pressure on said pliable member.

18. The device of claim 17, wherein said friction-reducing material comprises an abrasive cloth for enhancing a cleaning, polishing and buffing of said internal track surface.

19. The device of claim 18, wherein said friction-reducing material comprises a material for lubricating said internal surface of said tack opening to enhance reducing a friction threat.

20. The device of claim 19, wherein said cleaning material comprises soap.

21. The device of claim 19, wherein said friction reducing material comprises a wax material to enhance reducing a friction at said surface of said track opening.

22. The device of claim 16, wherein said support member comprises a cordage member fabricated from synthetic fibers.

23. The device of claim 16, wherein said sheet member comprises perforated plastic.

24. The device of claim 5, wherein said pliable member further comprises a compressible, flexible, pliable, wrapping member for changing a working surface defined by said pliable member; said working surface being defined by said first flattened and strip sections, and for effecting said cleaning and maintenance operations; said wrapping member being removably joined to said pliable member by said control member so as to allow said wrapping member and said pliable member to be concurrently inserted in slidable engagement within said track opening, and to be concurrently, adjustably shaped by said pliable member to enable said pliable member and wrapping member to compress and substantially correspond to said T-shape of said track opening.

25. The device of claim 24, wherein said wrapping member removes and receives contaminants from said track opening during cleaning and maintenance operations so as to substantially minimize an impregnation of said pliable member with said removed contaminants; said wrapping member being said joined to said pliable member in a manner to allow said wrapping member to be removed from said pliable member when impregnated with said contaminants, and when said wrapping member loses a capability to satisfactorily perform cleaning and maintenance operations; and said removed wrapping member serving to allow said working surface of said pliable member to remain sufficiently clean for subsequent cleaning and maintenance operations, and for receiving thereon a different clean wrapping member.

26. The device of claim 25, wherein said wrapping member is adapted to enclose said pliable member so as to match said T-shape of said pliable member; said wrapping member being joined to said pliable member in a manner to prevent said wrapping member from becoming free of said pliable member; said wrapping member being selected from a group of material and synthetic fabrics used to perform lubricating, cleaning, polishing and waxing applications; said wrapping member being tied to said pliable member with a pair of cordage members defined by said control member through a lace arrangement; and wherein pulling each cordage member in counter directions simultaneously applies said compression to said pliable member and wrapping member enclosed thereabout.

27. The device of claim 3, wherein said pliable member is elongated and includes a top side, a bottom side, and two longitudinally spaced, transverse, end sides; the top side being formed by said upright strip section; said upright strip section extending longitudinally between said transverse end sides; said bottom side being formed by said flattened section; said strip section including a pair of spaced, lateral, parallel, side walls extending from said flattened section; said pliable member being prefolded, such that, a different portion of said strip section projects outward from a matching one of said pair of lateral strip walls; each different projecting strip portion being contiguous with an upper region of said top strip side; said projecting strip portions slidably engaging a shape of a fourth external surface region of said mast which adjoins said track opening, and said strip portions also conforming to the shape of the fourth external surface of said track opening when said inserted pliable member is compressed with said control member.

28. The device of claim 27, further comprising an elongated holder member for retaining said inserted first flattened and strip sections in slidable engagement within said track opening; said holder member being releasably, slidably fixed to said track opening; said pliable member being releasably attached to said holder member in a manner for said holder member to exert a firm pressing pressure on said top side of said upright strip section of said pliable member when said holder member is said slidably fixed to said track opening; said holder member retaining said pliable member between said holder member and said track opening; and said pressure preventing said inserted pliable member from becoming free of said track opening while said first flattened and strip sections are being slidably moved within said track opening.

29. The device of claim 28, wherein said pliable member further comprises a pair of spaced, rigid, guide members for directing a motion of said pliable member when said pliable member is being slid within said track opening, and for retaining said inserted, first flattened and strip sections within said track opening when said first flattened and strip sections are being slid within said track opening; each one of said pair of guide members being attached to a different one of the spaced, opposed, transverse, end sides of said pliable member; and said pair of guide members having a shape corresponding to a shape of a channel-like aperture defined by boundaries of said first, external, surface region of said track opening.

30. The device of claim 29, wherein each one of said pair of guide members comprises a plastic material.

31. The device of claim 3, wherein said pliable member is prefolded to further include a second flattened section; said second flattened section slidably engaging and conforming to a fourth external surface region of said mast which adjoins said track opening, when said inserted pliable member is compressed through said control member; said second flattened section being supported by said upright strip section and being formed integrally therewith; and said second flattened section providing said pliable member with a general H-shape.

32. The device of claim 31, wherein said pliable member is elongated and includes a top side, a bottom side, and two, longitudinally-spaced, transverse, end sides; the top side being formed by said second flattened section; said upright strip extending longitudinally between said transverse end sides; said bottom side being formed by said first flattened section; said strip section including a pair of spaced, lateral, parallel, side walls extending between said first and second flattened sections; said pliable member being prefolded, such that, a different longitudinally extending side portion of said second flattened section projects outward from a matching wall of said strip section; said projecting side edge portions of said second flattened section slidably engaging said fourth external mast surface; and said projecting side portions of said second flattened section conforming to a shape of said fourth external mast surface when said inserted pliable member is compressed with said control member.

33. The device of claim 32, further comprising an elongated holder member for retaining said inserted first and second flattened sections and said strip section in slidable engagement within said track opening; said holder member being releasably, slidably, fixed to said track opening; said pliable member being releasably attached to said holder member in a manner for said holder member to exert a firm pressing pressure on said second flattened section when said holder member is said slidably fixed to said track opening; said holder member retaining said pliable member between said holder member and said track opening; and said pressure preventing said inserted pliable member from becoming free of said track opening while said first and second flattened sections and said strip section are being slidably moved within said track opening.

34. The device of claim 33, wherein said pliable member further comprises a pair of spaced, rigid, guide members for directing a motion of said pliable member when said pliable member is being slid within said track opening and for retaining said inserted first and second flattened sections and said strip section within said track opening when said first flattened and strip section are being slid within said track opening; each one of said pair of guide members being attached to a different one of said spaced, opposed, transverse, end sides of said pliable member, and said pair of guide members having a shape corresponding to a shape of a channel-like aperture defined by boundaries of said first external surface of said track opening.

35. The device of claim 34, wherein each one of said pair of guide members comprises a flattened plastic material.

36. A device for maintaining an elongated, generally, T-shaped spar track for a free running of mating slides and boltropes under loadings of a sail through cleaning and maintenance, wherein a first internal surface region of a T-shaped track opening is comparatively wider than a second internal surface region, and wherein the second internal surface region of said track opening merges with a third external region of said track opening; and wherein the improvement comprises:

a. a compressible, flexible, pliable member for cleaning, lubricating and maintenance of said T-shaped track opening; said pliable member being prefolded and united to provide a shape corresponding to said T-shaped track opening;

b. said pliable member resembling said T-shape of said track opening to facilitate insertion of said pliable member into said track opening and to enable said pliable member to be in slidable engagement with said track opening;

c. a control member for adjustably shaping said pliable member when said inserted within said track opening; the control member adjustably shaping said pliable member to allow said pliable member to compress and to substantially correspond to said T-shape of said track opening; and wherein said inserted pliable member is in slidable engagement with said track opening when subjected to compression through said control member, and when being slidably moved to allow effects of corrosion to be reduced and thereby enhance a free running of said slides and boltropes under said loadings; and d. further comprising an elongated holder member for retaining said pliable member in said slidable engagement within said track opening; said holder member being removably, slidably fixed to said track opening with a row of track slides attached to said holder member; said pliable member being releasably attached to said holder member in a manner for said holder member to exert a firm pressing pressure on said pliable member through said row of track slides when said holder member is slidably fixed to said track opening; said holder member retaining said pliable member between said holder member and said track opening; and said pressure preventing said inserted pliable member from becoming free of said track opening while said first flattened and strip sections are being slidably moved within said track opening.

* * * * *